US005538248A

United States Patent [19]

Shillito et al.

[11] Patent Number: 5,538,248

[45] Date of Patent: Jul. 23, 1996

[54] HOLDER FOR JIGSAWS

[75] Inventors: David D. Shillito; Denis T. Parkinson, both of Tyldesley, United Kingdom

[73] Assignee: Parker Hilton Limited, Manchester, United Kingdom

[21] Appl. No.: 392,811

[22] PCT Filed: Aug. 19, 1993

[86] PCT No.: PCT/GB93/01768

§ 371 Date: Apr. 17, 1995

§ 102(e) Date: Apr. 17, 1995

[87] PCT Pub. No.: WO94/05388

PCT Pub. Date: Mar. 17, 1994

[30] Foreign Application Priority Data

Aug. 28, 1992 [GB] United Kingdom ..... 9218305

[51] Int. Cl.[6] ..... A63F 9/10

[52] U.S. Cl. ..... 273/157 R; 273/148 R

[58] Field of Search ..... 273/157 R, 148 R, 273/DIG. 30; 206/315.1

[56] References Cited

U.S. PATENT DOCUMENTS

| | | | |
|---|---|---|---|
| 3,504,915 | 4/1970 | Walker | 273/157 R |
| 3,889,743 | 6/1975 | Presnick | 165/46 |
| 4,436,307 | 3/1984 | Caldwell | 273/157 R |
| 4,441,626 | 4/1984 | Hall | 220/443 |
| 4,479,651 | 10/1984 | LaFleur | 273/157 R |

FOREIGN PATENT DOCUMENTS

| | | | |
|---|---|---|---|
| 2203056 | 10/1988 | United Kingdom | 273/157 R |
| 2210800 | 6/1989 | United Kingdom | 273/157 R |

*Primary Examiner*—Benjamin H. Layno
*Attorney, Agent, or Firm*—Loeb & Loeb

[57] ABSTRACT

A jigsaw holder comprising a support member on which the jigsaw can be assembled, and a cover pivoted or hinged to the support member so as to be able to overlie the latter. The surface of the cover has a compressible non-slip layer to lock the assembled jigsaw pieces in position. Velcro tabs releasably secure the cover means in overlying relationship to the support member. The surface of the support member also has a non-slip compressible layer. A retaining sheet is provided to trap non-assembled jigsaw pieces between same and the cover.

12 Claims, 1 Drawing Sheet

16
20
18
21

16
15
27
26
13
20
14
19
13
25
12
24
23
11
23
24
23
14
15
22
15
17
10
25
11
22
15

HOLDER FOR JIGSAWS

This invention relates to a holder on which jigsaw puzzles (hereinafter and in the claims referred to simply as "jigsaws") can be assembled and which permits incomplete jigsaws to be "frozen" in the incomplete or unfinished state and stored away for future use and completion.

It is known to provide a holder for a jigsaw in which there is a friction lined playing surface and a cover or covers hinged to the playing surface. The cover(s) may have a compressible blanket or pad adapted to engage the assembled or partly assembled jigsaw when the cover overlies the playing surface.

One of the problems with such holders is that air can get trapped behind the lining of the playing surface resulting in an uneven playing surface. Furthermore, once the jigsaw is assembled it cannot be removed without dismantling it.

It is an object of the present invention to provide a jigsaw puzzle holder which obviates or mitigates the above drawbacks.

According to the present invention there is provided a holder for a jigsaw comprising a support member having a non-slip playing surface on which a jigsaw can be assembled, a cover member pivoted or hinged to the support member so as to be moveable between an open position in which said playing surface is exposed and a closed position in which the cover member overlies the support member and playing surface the surface of the cover member adapted to lie adjacent the support member being of a compressible non-slip nature to lock assembled and/or unassembled jigsaw pieces in position and means for releasably securing the cover member to the support member in overlying relationship to the support member, wherein each of said members is formed of at least a protective layer and a non-slip layer whereby said layers are sealed around their outer peripheral edges, the holder being characterised in that there is provided a passage extending between the support member and the cover member so that in said open position air from under the non-slip surface of the support member can be expelled to under the non-slip surface of said cover member via said passage.

The passage should preferably extend to the cover member such that air can be expelled from the support member to the cover member.

Preferably, the cover member adapted to lie adjacent the support member is covered with non-slip plastics foam material, or flock material and has a layer of compressible material. The air expelled from the support member to the cover member provides an extra cushioning and gripping action when the cover overlies the pieces on the playing surface.

Preferably the non-slip surface of the cover member and the playing surface are sealed to a protective material on the other side of the holder, and air in the playing surface under the non-slip surface is expelled to the cover member via said passage.

Preferably the cover member is separated from the playing surface by means of a hinge which comprises the protective material and non-slip surface being sealed together. The passage comprises a channel through the sealed hinge.

Preferably there are a plurality of passages in each hinge.

In a preferred embodiment there is provided a non-slip mat which may overlie said playing surface and on which the jigsaw pieces can be assembled. This permits an assembled jigsaw to be moved intact from the holder.

An embodiment of the present invention will now be described, by way of example, with reference to the accompanying drawing, in which.

Figures 1, 2, 3:
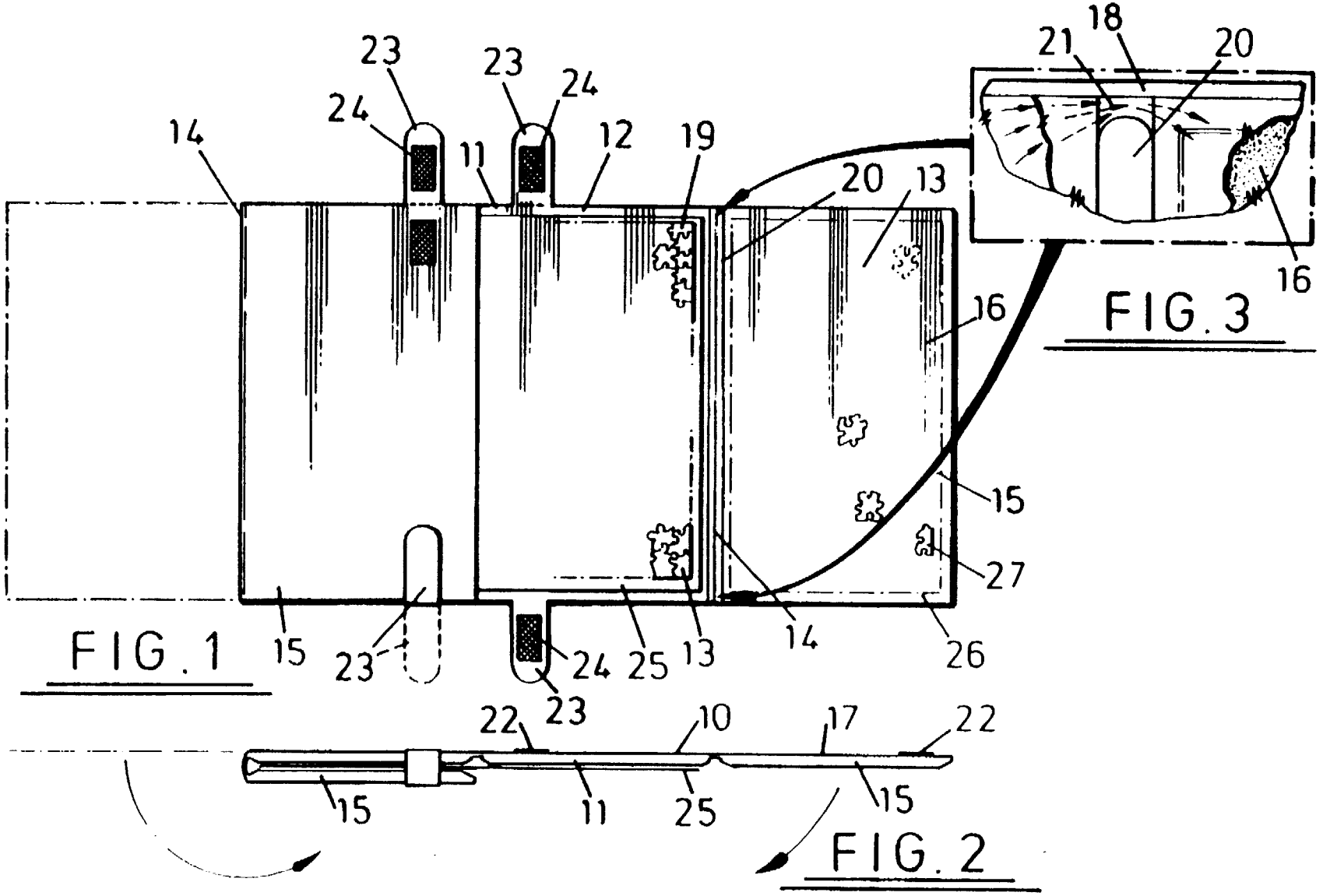
FIG. 1 is a plan view of a jigsaw holder according to the present invention in the part open position.
FIG. 2 is a top end view of FIG. 1.
FIG. 3 is an inset fragmented view of an air channel of the present invention.

The holder 10 comprises a support member 11 formed with a playing surface 12 formed of, or covered with, for example, flock vinyl 13 on which a jigsaw can be assembled. The playing surface 12 may be made or covered with any other non-slip, preferably compressible material.

The support member 11 has hinged or pivoted as indicated at 14 to each of two opposed sides a cover member 15 which has a layer 16 of compressible, foam material covered by a non-slip material 13, for example, flock vinyl.

The support member 11 and the cover members 15 are of the same construction with the cover members being thicker than the support member 11. Each member 11 or 15 is formed of four layers, namely an outer smooth protective plastics layer 17 such as vinyl, a layer of cardboard or similar in contact with the outer layer, a layer 16 which has compressible characteristics, for example compressible plastics foam or other spongy material, in contact with the cardboard layer, and an inner, non-slip layer 13 of flock vinyl or similar. The four layers are heat welded together around their outer peripheral edges to form an edge seal 18.

The cover members 15 are spaced apart from the playing surface 12 and are connected thereto by means of a hinge 20 formed from a heat-weld seal between the protective plastics layer 17 and the non-slip surface 13. The hinge seal 20 falls short of the edge seal 18 to form a channel 21 at the top and bottom of each hinge 20, connecting the playing surface to the cover members.

The channel 21 allows the air trapped under the non-slip layer 13 of the playing surface 12 to be expelled and forced into the cover members 15 and the compressible material 16 (see dotted arrows). The air collects under the non-slip surface 13 of the cover members to give each cover 15 a cushioning effect when it covers the jigsaw. The covers 15 are able to give a better grip to the jigsaw with the air trapped within them.

The outer surface of each cover member 15 is provided with a layer 22 of VELCRO (Trade Mark) adjacent each of two opposed edges, and the support member 11 is provided with four hinged securing tabs 23, one for each layer 22, and each with an area 24 of VELCRO fitted thereto. The tabs 23 form fasteners to secure the cover members 15 in closed position (see left hand side of FIG. 1).

A flexible backing sheet 25 may be provided to overlie the playing surface. This backing sheet 25 is formed of or covered with flock vinyl on each of its surfaces. It can be used to support the jigsaw pieces 19 as they are assembled instead of assembling them directly on the playing surface 12. Once the jigsaw 19 is assembled the backing sheet 25 may be lifted from the holder with the assembled jigsaw thereto. This backing sheet 25 may then be incorporated into a framing assembly kit for the assembled jigsaw allowing the jigsaw to be displayed.

A flexible retaining sheet 26 (shown dotted) may be provided, preferably for each cover member 15 but only one may be provided if required. This retaining sheet 26 is formed of or covered with flock vinyl on each of its surfaces. It can be used to support non-assembled jigsaw pieces 27 between the retaining sheet 26 and its respective cover members 15, the cover members 15 being secured in position against movement by the fastening tabs 23.

The holder permits assembled and unassembled pieces of the jigsaw to be mounted on the playing surface 12 and the inside of each cover 15 respectively. The non-slip surfaces of the playing surface 12 and the inside of each cover 15 allow the user to use the holder in an inclined position e.g. in bed. Furthermore the non-slip surfaces grip the pieces to enable the cover members 15 to be pivoted about the hinges to the closed position without the pieces falling from their place.

The holder 10 may be provided with a handle.

We claim:

1. A holder for a jigsaw comprising a support member having a non-slip playing surface on which a jigsaw can be assembled, a cover member pivoted or hinged to the support member so as to be moveable between an open position in which said playing surface is exposed and a closed position in which the cover member overlies the support member and playing surface the surface of the cover member adapted to lie adjacent the support member being of a compressible non-slip nature to lock assembled and/or unassembled jigsaw pieces in position and means for releasably securing the cover member to the support member in overlying relationship to the support member, wherein each of said members is formed of at least a protective layer and a non-slip layer whereby said layers are sealed around their outer peripheral edges, the holder being characterised in that there is provided a passage extending between the support member and the cover member so that in said open position air from under the non-slip surface of the support member can be expelled to under the non-slip surface of said cover member via said passage.

2. A holder according to claim 1, wherein the cover member is covered with a non-slip plastics foam material, or flock material.

3. A holder according to claim 1 or 2, wherein the cover member has a layer of compressible foam like material.

4. A holder according to claim 1 wherein the surface of the cover member and the playing surface on one side of the holder are heat-sealed to a protective material on the other side of the holder.

5. A holder according to claim 1 wherein air can be expelled from under the playing surface to the compressible material under the surface of cover member via said passage.

6. A holder according to claim 1 wherein, the cover member is separated from the support member by means of a hinge.

7. A holder according to claim 5 or 6, wherein the hinge comprises the protective material and non-slip surface being sealed together.

8. A holder according to claim 7, wherein the passage comprises a channel through the sealed hinge.

9. A holder according to claim 7, wherein there are a plurality of passages in each hinge.

10. A holder according to claim 7 wherein the passage is defined by a gap between the hinge seal and an edge seal at the holder.

11. A holder according to claim 8, wherein there is provided a backing sheet removably locatable in said playing surface and in which a jigsaw may be assembled.

12. A holder according to claim 1, wherein the backing sheet has a non-slip surface.

* * * * *